United States Patent [19]

Mazur

[11] 4,011,637

[45] Mar. 15, 1977

[54] DEMOUNTABLE SWIVEL FASTENER WITH DETENT

[76] Inventor: Harry E. Mazur, Box 4508, Palm Springs, Calif. 92262

[22] Filed: Nov. 21, 1975

[21] Appl. No.: 634,050

[52] U.S. Cl. ..... 24/224 SS; 24/245 R

[51] Int. Cl.[2] ..... A44B 17/00

[58] Field of Search ..... 24/245, 73, 201 B, 222, 24/224

[56] References Cited

UNITED STATES PATENTS

| | | | |
|---|---|---|---|
| 1,463,949 | 8/1923 | Gerber | 24/245 R |
| 2,193,802 | 3/1940 | Chambless et al. | 24/224 SS |
| 2,260,778 | 10/1941 | Hodge | 24/245 L |
| 2,505,846 | 5/1950 | Anderson | 24/245 L |
| 3,406,434 | 10/1968 | Moskowitz | 24/245 R |
| 3,911,537 | 10/1975 | Mazur | 24/245 R |

FOREIGN PATENTS OR APPLICATIONS

| | | | |
|---|---|---|---|
| 282,489 | 2/1931 | Italy | 24/24 T |
| 8,124 | 11/1911 | United Kingdom | 24/224 SS |
| 16,920 | 5/1897 | United Kingdom | 24/245 L |

*Primary Examiner*—Dennis L. Taylor
*Attorney, Agent, or Firm*—Warren, Chickering & Grunewald

[57] ABSTRACT

A fastener comprising a combination of a headed stud and clasp member having openings respectively larger and smaller than the stud head and a connecting passageway sized for movement of the stud therethrough to an attached position with the clasp member confined by the stud head, and manually operable detent means barring return disconnecting movement of the stud and clasp member.

3 Claims, 8 Drawing Figures

Fig. 1
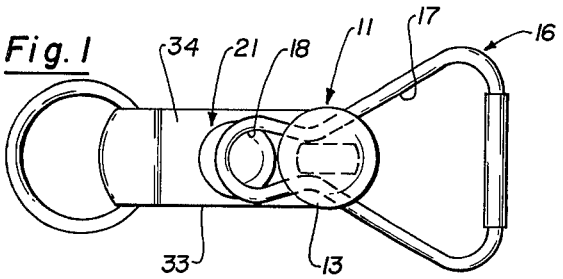
Fig. 3
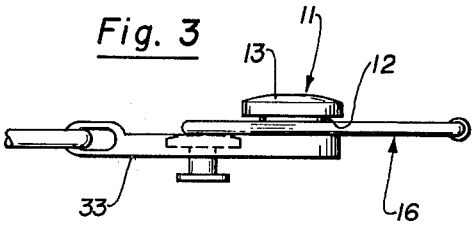
Fig. 2
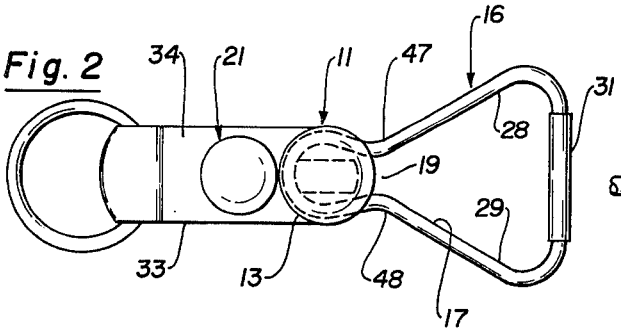
Fig. 4
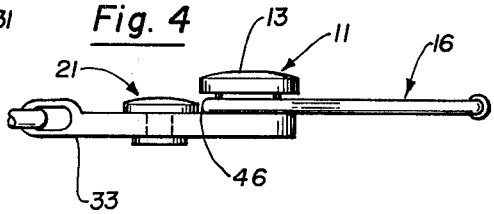
Fig. 6
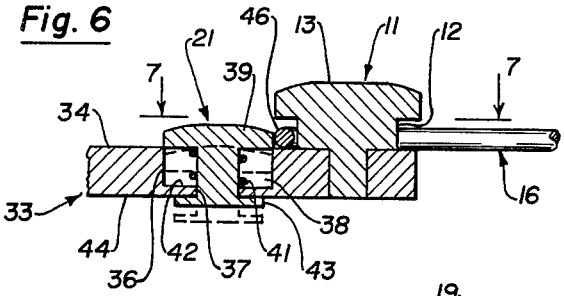
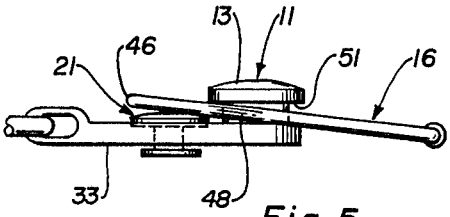
Fig. 5
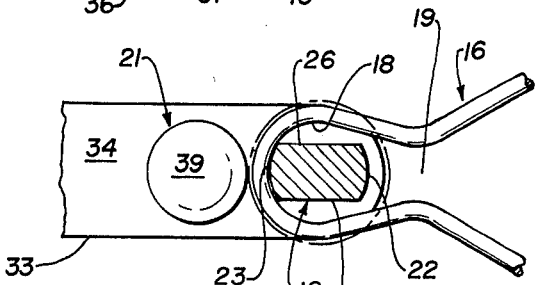
Fig. 7
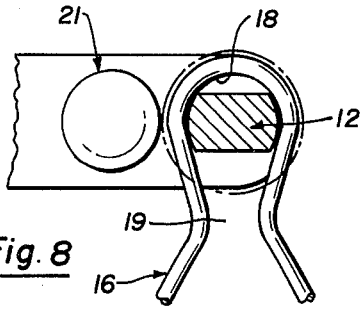
Fig. 8

DEMOUNTABLE SWIVEL FASTENER WITH DETENT

BACKGROUND OF THE INVENTION

The invention relates to fasteners of the general type disclosed in my U.S. Pat. No. 3,911,537.

Fasteners of the character described have very wide application where demountable fasteners are required; and an object of the present invention is to provide such a fastener which combines ease and speed of attachment and detachment with absolute safety.

Another object of the present invention is to provide a fastener of the character described which will afford, in addition to the above, full, free swivel action.

A further object of the invention is to provide a fastener of the character above in which the attaching parts may be optionally attached and detached with resilient snap action.

The invention possesses other objects and features of advantage, some of which of the foregoing will be set forth in the following description of the preferred form of the invention which is illustrated in the drawing accompanying and forming part of this specification. It is to be understood, however, that variations in the showing made by the said drawing and description may be adopted within the scope of the invention as set forth in the Claims.

BRIEF DESCRIPTION OF DRAWING

FIG. 1 is a plan view of a fastener constructed in accordance with the present invention, with the parts in partially assembled position.

FIG. 2 is a plan view similar to FIG. 1, with the parts in attached position.

FIG. 3 is a side elevation of the fastener, with the parts shown in their position as depicted in FIG. 1.

FIG. 4 is a side elevation, with the parts shown in attached position, as shown in FIG. 2.

FIG. 5 is a side elevation similar to FIGS. 3 and 4, but showing the parts in a different position.

FIG. 6 is an enlarged fragmentary cross-sectional view of the fastener.

FIG. 7 is a plan sectional view taken substantially on the plane of line 7—7 of FIG. 6.

FIG. 8 is a plan sectional view similar to FIG. 7, but showing the parts in a different position.

DETAILED DESCRIPTION OF INVENTION

The fastener of the present invention comprises, briefly, a stud 11 having a shank 12 and a relatively enlarged head 13; a member 16, having a thickness less than the length of shank 12 and first and second openings 17 and 18, respectively larger and smaller than head 13 and a connecting passageway 19 sized for movement of shank 12 therethrough; opening 18 being sized to surround shank 12 to provide an attached position upon movement of the shank through passageway 19 and into opening 18; and manually operable detent means 21 barring return movement of shank 12 from opening 18.

As will be best seen from FIGS. 7 and 8, opening 18 is of general arcuate shape, surrounding somewhat more than half of the periphery of shank 12 so as to be retained thereon with full swivel action. Also, importantly, shank 12 and passageway 19 are formed to permit movement of the shank through the passageway only upon a predetermined relative angular disposition of the shank and member, as seen in FIG. 7; and detent means 21 is aligned in the direction of connection and disconnection of member 16, that is, in alignment with the angular disposition of the parts as shown in FIG. 7. This structure is effected by forming shank 12 with wide and narrow dimensions, the wide dimension being substantially larger than the width of passageway 19, while the narrow dimension is adapted for movement through passgeway 19 when aligned therewith. Optionally, and as here shown, member 16 may be formed of resilient wire and with the width of passage 19 slightly less than the narrow dimension of shank 12 so as to resiliently yield to the passage of the shank therethrough with resilient snap action. Shank 12 is here shown with arcuately rounded ends 22 and 23, which represent the greater dimension of the shank and provide an arcuately segmented hub journalling the interior wall of opening 19. The shaft is here formed with opposed sides 26 and 27, which are flattened to provide the narrow dimension of the shaft and are disposed as chords of the circle defined by arcuate ends 22 and 23. From passageway 19, the opposite wire ends 28 and 29 diverge and then are inturned into a connecting sleeve 31 to complete the larger opening 17.

Preferably, stud 11 and detent means 21 are mounted on a support member 33 with shank 12 being connected to member 13 and projecting substantially perpendicular from a nominally top surface 34 thereof, the latter cooperating with head 13 to confine member 16 axially on shank 12 in its attached position, as seen in FIGS. 2, 4 and 6.

As will be best seen in FIG. 6, detent means 21 here comprises a stem 36 mounted for reciprocation in an opening 37 formed in support member 33, the latter also being formed with a relatively enlarged recess 28 sized to receive an enlarged head 39 on stem 36, permitting head 39 to be moved completely into recess 38 with the outer surface of the head flush with surface 34. Normally, the detent member is urged to an outward position of head 39, as seen in FIG. 6, by a spring 41 mounted in recess 38 around stem 36 and in compression between the underside of head 39 and the base 42 of the recess. The opposite (lower) end 43 of stem 36 is headed or peened out to support the detent member against the underside 44 of support member 33. In the normal spring-biased position of detent member 21, head 39 extends out from surface 34 to provide an abutment for the adjacent end 46 of member 16, it being noted from FIGS. 6 and 7 that head 39 is aligned with the greater dimension of shank 12. In such normal spring-biased position, detent head 39 positively prevents relative movement of the stud and clasp members in a direction moving shank 12 into the exiting passageway 19. In order to effect such disengagement of the parts, it is first necessary to manually depress the detent means so that end 46 may slide over the top of head 39, as depicted in FIGS. 1 and 3.

As a feature of the present invention, attachment of the parts may be effected by a proper initial deployment of the parts, followed by a simple, straight drawing together of the interlocking portions, shank 12 and opening 18. To effect initial deployment of the parts, the enlarged opening 17 in the clasp member is placed over the stud head 13 and then drawn laterally to place shank 12 at the entrance of passageway 19, as depicted in FIGS. 1 and 5. In this position of the parts, the detent member 21 may be manually depressed to permit the movement of the clasp member laterally across the top of head 39 and into attached position, as illustrated in FIGS. 2 and 4. However, with reference to FIG. 5, it will be noted that without manual depression of detent 21, clasp member 16 will be canted, as seen in FIG. 5, and a simple drawing together of the parts will automatically cause a camming of detent 21 to its depressed position as the clasp member is drawn to the stud shank. To effect this operation, the two legs of member 16 diverging from passageway 19 define spaced-apart skids adjacent the passageway which are spaced for engagement with the underside 51 of head 13, see FIG. 5, with the skids in straddling relation to shank 12. At the same time, the outer end 46 of member 16 will bear on the top of detent 21 so that as the members are drawn to attached position, end 46 will be forced down onto the top of detent 21, thereby moving it to its depressed, non-detenting position against the action of spring 41. As soon as end 46 is drawn off from the top of detent 21, as will occur when the parts move to attached position, detent head 39 will automatically spring outward under the action of spring 41 to provide its safety abutment function. Thereafter, deliberate manual depression of detent 21 is required to effect removal of the parts to detached position.

What is claimed is:

1. A fastener comprising:

a support, a stud having one end mounted on said support and a shank extending substantially perpendicularly to a surface of said support and having at its opposite end a relatively enlarged head positioned at a predetermined spacing from said surface;

a clasp member having a thickness less than said spacing for confinement between said head and surface and formed with first and second openings respectively larger and smaller than said head and a passageway connecting said openings;

said smaller opening being formed in an end of said clasp member and sized to surround said shank between said head and surface to provide a free swiveling attached position on said shank;

said shank and passageway being formed to permit and to confine movement of said shank through said passageway along a single axis of lineal reciprocation between attached and detached eal reciprocation between attached and detached positions in a predetermined angular position of said member on said shank;

means mounted on said support and providing a displaceable abutment movable into and from a position intersecting said axis and preventing and permitting respectively said axial reciprocation of said member and stud between attached and detached positions, said abutment in its axis intersecting position being positioned for engagement with said end for locking said member and stud in attached position;

means biasing said abutment to its said axis intersecting position; and said first-named means being formed for manual engagement and displacement of said abutment from its said position against the action of said biasing means thereby permitting displacement of said member and stud between attached and detached positions.

2. A fastener as defined in claim 1, said abutment extending outwardly from said surface in its said axis intersecting position and being manually displaceable to a non-abutting position substantially flush with said surface.

3. A fastener as defined in claim 2, said clasp member providing spaced-apart skids adjacent said passageway positioned for simultaneous engagement with said head and abutment and support surface in straddling relation to said shank for automatically displacing said abutment to its non-abutting position against the action of said biasing means upon movement of said clasp member from detached to attached position, said skids disengaging said abutment upon movement to attached position for automatic movement of said abutment to its axis intersecting position under the urge of said biasing means.

* * * * *

UNITED STATES PATENT AND TRADEMARK OFFICE

CERTIFICATE OF CORRECTION

PATENT NO. : 4,011,637

DATED : March 15, 1977

INVENTOR(S) : Harry E. Mazur

It is certified that error appears in the above-identified patent and that said Letters Patent are hereby corrected as shown below:

Column 2, line 35, change "28" to ---38---.

Claim 1, line 21, delete the entire line: "eal reciprocation between attached and detached".

Column 4, after claim 3, add the following claim:

---4. A fastener as defined in claim 3, said clasp member comprising a length of resilient wire having an arcuate portion defining said second opening and contiguous portions defining said skids and passageway and first opening; and said passageway being formed to pass said shank therethrough with resilient snap action.---

UNITED STATES PATENT OFFICE
CERTIFICATE OF CORRECTION

Patent No. 4,011,637 Dated March 15, 1977

Inventor(s) Harry E. Mazur

It is certified that error appears in the above-identified patent and that said Letters Patent are hereby corrected as shown below:

On the cover sheet "3 Claims" should read -- 4 Claims --.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*